US006405908B2

(12) United States Patent
Hood et al.

(10) Patent No.: US 6,405,908 B2
(45) **Date of Patent: *Jun. 18, 2002**

(54) STRAP SYSTEM AND METHOD FOR MAKING SAME

(75) Inventors: Michael Hood, Sevierville; Eric Heatherly, Murfreesboro, both of TN (US)

(73) Assignee: Psycobilly Products, LLC, Nashville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/911,982

(22) Filed: Jul. 24, 2001

Related U.S. Application Data

(63) Continuation of application No. 09/460,191, filed on Dec. 10, 1999, now Pat. No. 6,269,991.

(51) Int. Cl.[7] ..... A45F 3/14

(52) U.S. Cl. ..... 224/258; 224/910; 24/265 BC; 24/614

(58) Field of Search ..... 224/257, 258, 224/910, 580, 913; 24/265 R, 265 BC, 265 AL, 302, 614

(56) References Cited

U.S. PATENT DOCUMENTS

| | | | |
|---|---|---|---|
| 4,148,423 | A | 4/1979 | Schlacher |
| 4,254,901 | A | 3/1981 | McIntosh |
| 4,279,367 | A | 7/1981 | Jacobs |
| 4,930,695 | A | 6/1990 | Thompson et al. |
| 4,993,127 | A | 2/1991 | Mechem et al. |
| 5,082,155 | A | 1/1992 | Salvador |
| 5,165,584 | A | 11/1992 | Meagher et al. |
| 5,575,389 | A | 11/1996 | Alspach et al. |
| 5,660,445 | A | 8/1997 | Murray |
| 5,868,293 | A | 2/1999 | D'Addario et al. |
| 6,101,687 | A | 8/2000 | Giampavolo et al. |
| 6,202,262 | B1 | 3/2001 | Hamburger, III |

*Primary Examiner*—Stephen K. Cronin
(74) *Attorney, Agent, or Firm*—Luedeka, Neely & Graham PC

(57) ABSTRACT

A strap for guitars and the like made from recycled seat belt components. The strap includes as its components a male seat belt buckle member insertably retainable within a female seat belt buckle member, a first length of seat belt strap material and a second length of seat belt strap material, first and second slip buckles; and a pair of connecting members, each having a length of sheet material having an aperture defined adjacent an end thereof.

3 Claims, 7 Drawing Sheets

STRAP SYSTEM AND METHOD FOR MAKING SAME

This application is a continuation of application Ser. No. 09/460,191, filed Dec. 10, 1999, and entitled STRAP SYSTEM AND METHOD FOR MAKING SAME now U.S. Pat. No. 6,269,991.

FIELD OF THE INVENTION

This invention relates generally to strap devices. More particularly, this invention relates to straps made using parts of seat belts and to a method for recycling seat belts in the manufacture of straps.

BACKGROUND AND SUMMARY OF THE INVENTION

Conventional straps including straps for musical instruments, such as guitars, desire improvement in that they often have relatively low aesthetic appeal and other shortcomings. One shortcoming is that guitar straps made from all new materials have an undesirable environmental impact.

Accordingly it is an object of the present invention to provide an improved strap system and, in particular, to a strap suitable for use with musical instruments such as guitars.

A further object of the invention is to provide a strap of the character described having improved aesthetics as compared to conventional straps.

Another object of the invention is to provide a strap of the character described that can be manufactured by recycling used materials, particularly using seat belt components.

An additional object of the invention is to provide a strap of the character described that is economical.

Still another object of the invention is to provide a method for manufacturing straps of the character described using components from seat belts.

With regard to the foregoing and other objects, the present invention is directed to the recycling of a seat belt assembly of an automobile by taking components of the seat belt and making a strap member therefrom.

In a preferred embodiment, the strap includes as components an automobile seat belt buckle system including a male seat belt buckle member insertably retainable within a female seat belt buckle member, a pair of elongate strap members including a first length of seat belt strap material and a second length of seat belt strap material, first and second slip buckles, first and second connecting members, each including a length of sheet material having an aperture defined adjacent an end thereof.

The components are assembled by attaching the first length of seat belt strap material to the female seat belt buckle member and attaching the first connecting member to the first length of seat belt strap material opposite the female seat belt buckle member so that the end of the connecting member having the aperture is free. This provides a fixed length member.

An adjustable length member is made by attaching the second connecting member to the first slip buckles to provide a connecting/buckle member; attaching the second length of seat belt strap material to the male buckle member to provide a buckle/strap member having the male seat belt buckle defining one end thereof and a free end of the second length of seat belt strap material defining the other end thereof, slidably positioning the second slip buckle along the buckle/strap member intermediate the ends thereof, slidably positioning the connecting/buckle member along the buckle/strap member so that the connecting/buckle member is between the second slip buckle and the free end of the buckle/strap member, passing the free end of the buckle/strap member through a portion of the second slip buckle, and attaching the free end of the buckle/strap member to a portion of the second length of seat belt strap material to fix the position of the free end of the buckle/strap member relative to the second slip buckle.

As will be appreciated, the strap has aesthetic appeal unlike those of conventional straps. In a preferred embodiment, the aesthetics are further enhanced by incorporating one or more indicia bearing members onto the strap. These may be indicia also recycled from an automobile, such as a hood ornament or the like. In this regard, it will further be appreciated that the invention also promotes recycling of used automobile parts in a constructive and environmentally friendly manner.

BRIEF DESCRIPTION OF THE DRAWINGS

Further advantages of the invention will become apparent by reference to the detailed description of preferred embodiments when considered in conjunction with the figures, which are not to scale, wherein like reference numbers, indicate like elements through the several views, and wherein.

DETAILED DESCRIPTION

Figure 1:
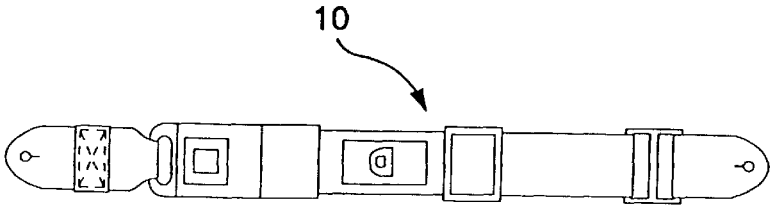
FIG. 1 is a top plan view of a strap in accordance with a preferred embodiment of the invention.
Figure 2:
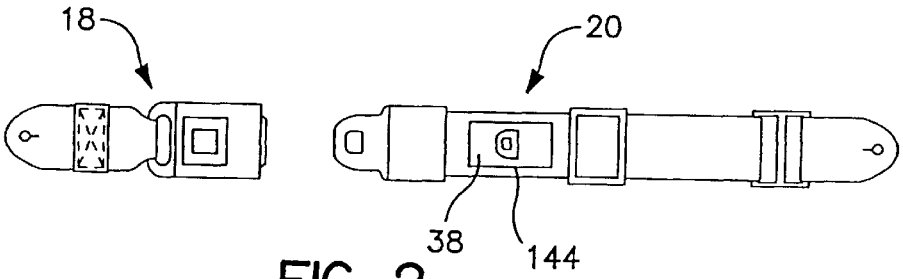
FIG. 2 is a top plan view of the strap of FIG. 1 showing the two major components thereof separated from one another.
Figure 3:
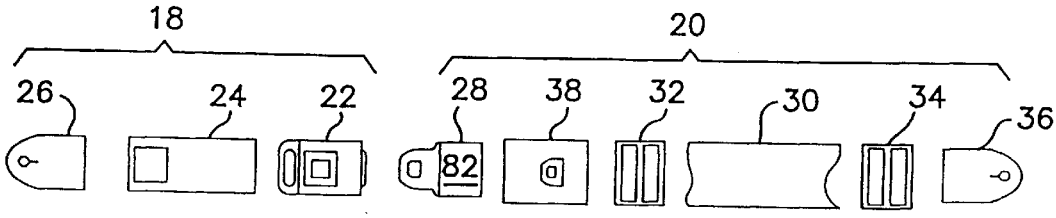
FIG. 3 is an exploded top plan view of the strap of FIG. 1.
Figure 4:
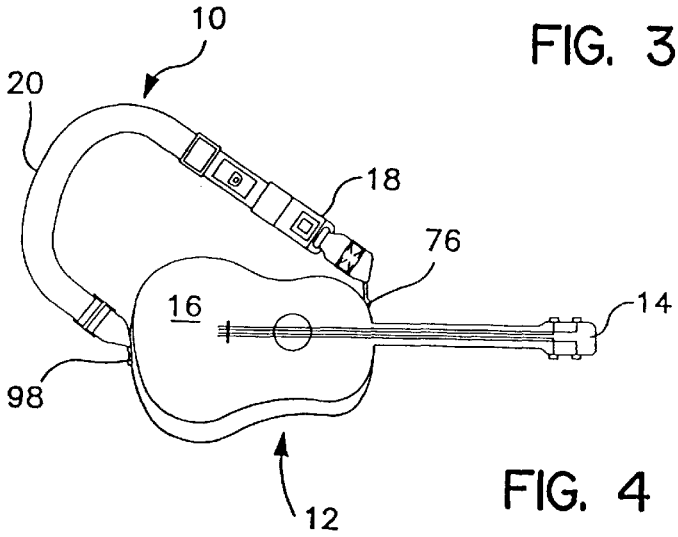
FIG. 4 is a perspective view showing the strap of FIG. 1 attached to a guitar.

With initial reference to FIGS. 1 and 2, there is shown a preferred embodiment of a strap 10 in accordance with the invention. The strap 10 is particularly suitable for use with musical instruments, such as a guitar 12 having a head 14 and a body 16 (FIG. 4).

The strap preferably includes a fixed length member 18 connectably attachable with an adjustable length component 20 (FIG. 2). Both members 18 and 20 are attachable with the guitar 12. The fixed length member 18 preferably includes a female buckle member 22, a strap member 24 and a connecting member 26. The adjustable length member 20 preferably includes a male buckle member 28, strap member 30, slip buckles 32 and 34, a connecting member 36 and one or more indicia bearing members 38.

While the preferred embodiment is described as having a fixed length component and a length adjustable component, it will be understood that a suitable strap system could have a fixed length component modified in the manner of the adjustable length component so as to be of adjustable length. Likewise, the adjustable length component could be made of a fixed length. Thus, the strap system could include two fixed length components or two adjustable length components configured to be detachably connected in the manner of the described embodiment.

Figure 5A:
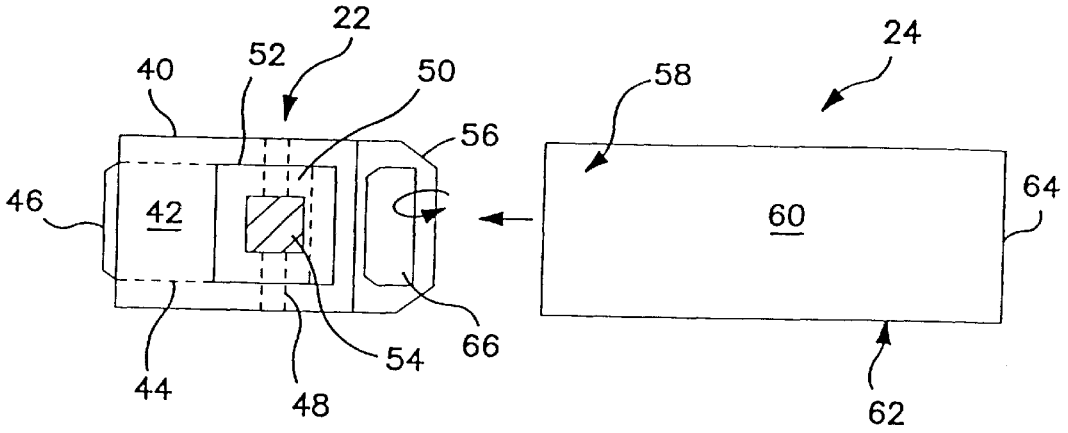
FIGS. 5*a*–5*c* show steps in the manufacture of a first of the major components of the strap of FIG. 1.
Figure 5B:
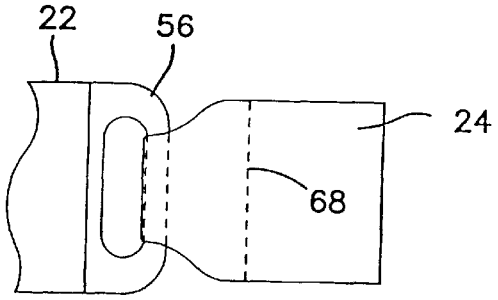
Figure 5C:
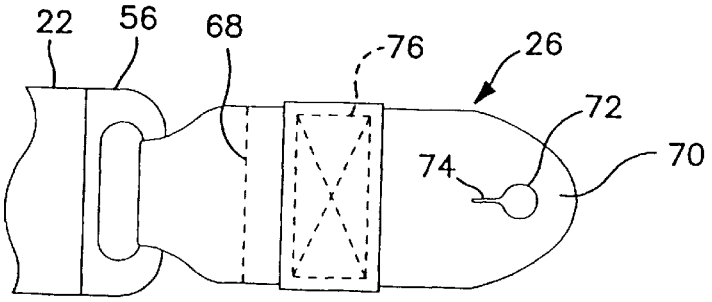

Turning now to FIGS. 5*a*–5*c*, there are shown a preferred assembly of the fixed length member 18 which includes the female buckle member 22, strap member 24 and connecting member 26. The female buckle member 22 is preferably a female buckle component of a conventional buckle assembly of an automobile seatbelt system. The male buckle member 28 is the corresponding male buckle component of the buckle assembly. A preferred buckle assembly is that obtainable from 1970's vintage automobiles, such as a 1970 Cadillac Fleetwood or the like.

The construction of the buckle member 22 is well-known and includes a substantially rectangular body portion 40 having a substantially flat or planar bottom surface opposite a top surface 42. Within the body portion 40 is a cavity 44 having an open entrance end 46 and an associated spring-loaded latch mechanism 48 of a type that is well-known and common to seat belts for selectively retaining a male buckle component inserted into the cavity 44.

A button 50 is positioned within an aperture 52 extending between the cavity 44 and the top surface 42. The button 50 is urged away from the cavity 44 and toward the surface 42 by the spring of the latch mechanism 48, but is limited in its movement away from the cavity 44 by a flange or the like that engages the edges of the aperture 52. The button 50 may be depressed to release a male buckle member captured by the latch mechanism, as explained below. Typically, a central portion of the button 50 includes indicia 54 relating to the make or model of the automobile on which the seat belt from which the female buckle member 22 was installed.

A ring-like projection 56 extends from the end of the member 22 opposite the end 46. An end portion 58 of the strap member 24 is attached to the projection 56 as shown in FIG. 5*b*. In this regard, it is noted that the strap member 24 is preferably a portion of an automobile seat belt strap or web and includes a top surface 60, bottom surface 62, and an end portion 64 opposite the end portion 58. The strap member 24 preferably has a length of from about 2 to about 10 inches, most preferably from about 3 to about 4 inches, and a width of from about 1½ to about 2½ inches, most preferably about 2 inches. The strap member 24 is attached to the projection 56 by sliding the strap member 24 through an aperture 66 of the projection 56 so that the strap member can be folded in half over itself. Stitches 68 may then be used to secure the halves of the strap member 24 together around the projection 56. In this regard, it is noted that the width of the aperture 66 is preferably about half the width of the strap member 24. Thus, it is preferred that the edges of the strap member 24 be folded inwardly as shown in FIG. 5*b* for aesthetic purposes.

The connecting member 26 is used to attach the strap 10 to a musical instrument and is preferably made from a strong sheet material, such as leather or the like. The connecting member 26 is substantially rectangular with a rounded free end 70, and is preferably made from an elliptical blank folded over itself in the manner described below for connecting member 36 in connection with FIG. 7*a* below. However, the member 26 could also be a single thickness made in the general configuration and not folded. An aperture 72 with a slit portion 74 extends through the member 26 adjacent the end 70. The member 26 is attached to the strap member 24 opposite the portion of the strap member 24 secured to the projection as by stitches 76. The length of the connecting member is preferably from about 2 to about 4 inches, most preferably about 3 inches. Returning to FIG. 4, aperture 72 and slit portion 74 are configured to frictionally engage a peg 76 located on a front portion of the body 16 of the guitar 12.

Figure 6A:
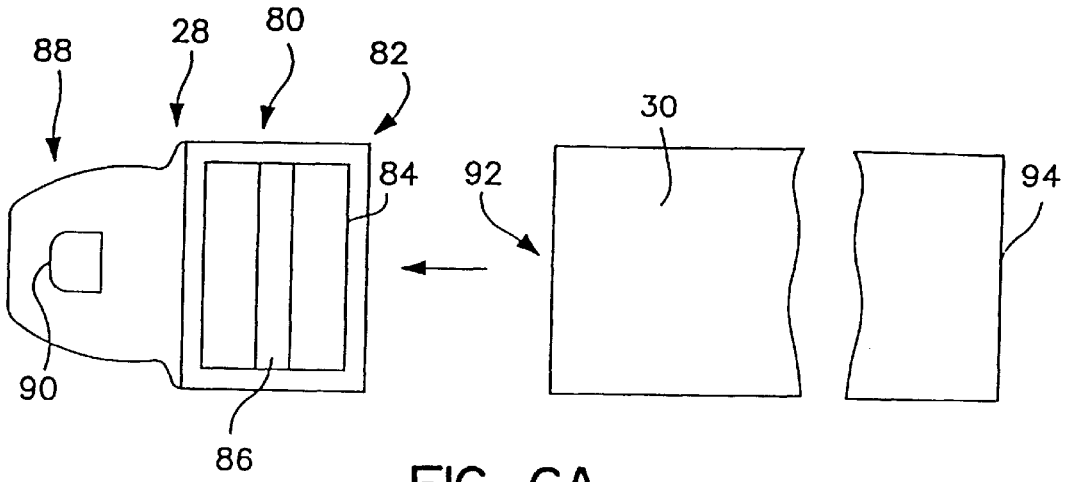
FIGS. 6*a*–6*c* are bottom plan views showing steps in the manufacture of part of a second major component of the strap of FIG. 1, namely attachment of a primary strap member to a male buckle member.
Figure 6B:
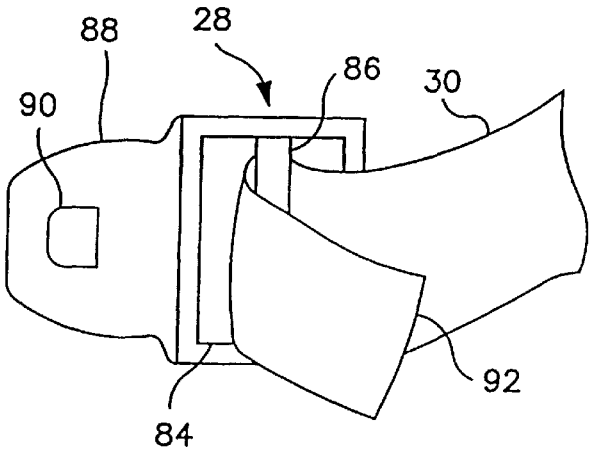
Figure 6C:
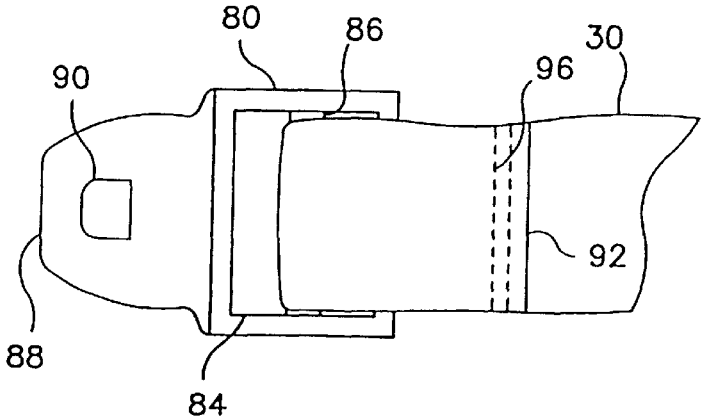

Now, with reference to FIGS. 6*a*–6*c*, 7*a*–7*b*, 8, and 9 preferred steps are shown in the manufacture of the adjustable length member 20. As shown in FIGS. 6*a*–6*c*, the male buckle member 28 includes a rectangular body portion 80 having a substantially flat or planar top surface 82 opposite an open bottom that defines a blind bore 84 having a post 86 slidably positioned across the width of the bore 84.

A projection 88 extends from one end of the body portion 80 for being inserted into the cavity 44 through the open end 46 of the female buckle member 24. An aperture 90 extends through the projection 88 for engaging the latch mechanism 48 of the female buckle member 24 to enable the male buckle member 28 to be selectively locked to the female buckle member 24. The button 50 of the female buckle member 24 may be depressed to disengage the latch mechanism 48 from the aperture 90 and the projection slid out of the cavity 44 for detachment of the male buckle member 28 from the female buckle member 24.

The strap member 30 includes opposite ends 92 and 94 and is preferably identical to the strap member 24, except that it preferably has a length of from about 35 to about 55 inches, most preferably about 45 inches. The strap member 30 is connected to the male buckle member 28 by sliding the end 92 of the strap into the cavity 84 from the end of the cavity 84 opposite the projection 88. The end 92 is then passed around the post 86 and pulled away from the cavity 84 so that the end 92 overlaps about two or so inches of the strap member 30 (FIG. 6*b*). The end 92 is secured in place to the strap member 30 as by stitches 96 (FIG. 6*c*).

Figure 7A:
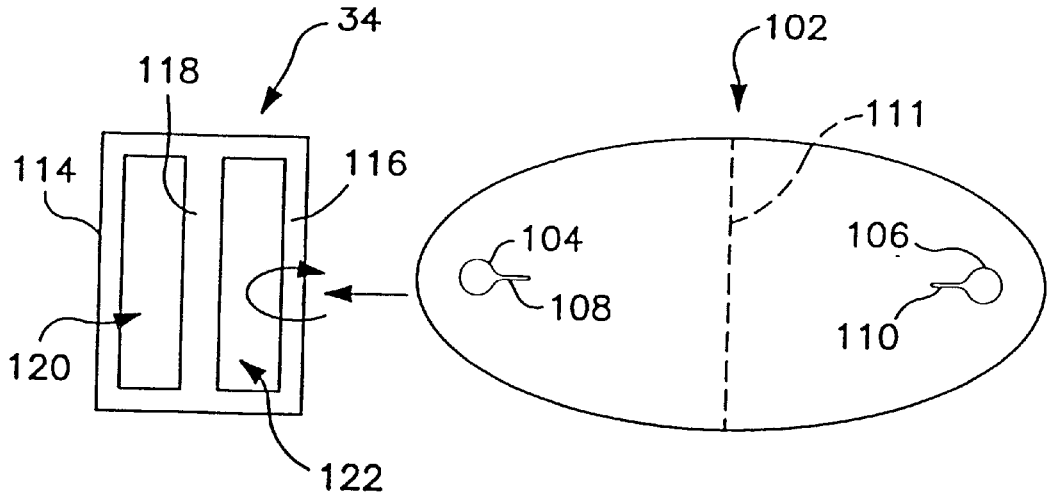
FIGS. 7*a*–7*b* show steps in the manufacture of another portion of the second major component of the strap of FIG. 1.
Figure 7B:
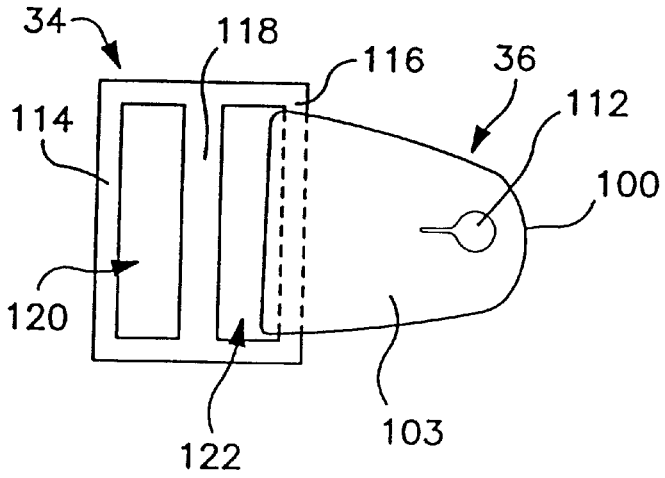

FIGS. 7*a* and 7*b* show attachment of connecting member 36 to slip buckle 34. The connecting member 36 is preferably identical to the connecting member 26 and is used to attach the strap 10 to a peg 98 adjacent a rear end of the body 16 of the guitar 12. The connecting member 36 is substantially rectangular with a rounded free end 100, and is preferably made from an elliptical blank 102 folded in half (about fold line M) around the slip buckle 34 and secured as by stitches 103 and/or adhesive. The blank 102 includes a pair of apertures 104 and 106 having respective slit portions 108 and 110, which overlie one another to provide aperture 112 which frictionally engages the peg 98.

Figure 8A:
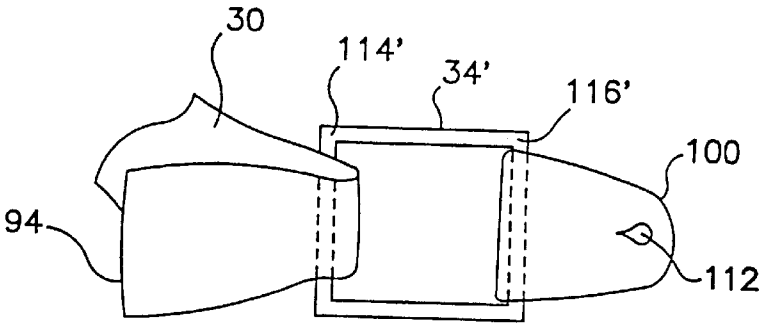
FIG. 8*a* shows another embodiment of a slip buckle configuration.

The slip buckle 34 is substantially rectangular and of molded plastic or metal construction. The buckle 34 includes end posts 114 and 116, with middle post 118 there between to define apertures 120 and 122. The connecting member 36 is preferably attached to the buckle 34 by folding the blank 102 through the aperture 122 and around the end post 116 and then securing the folded portions together with the apertures 104 and 106 aligned. Alternatively, the slip buckle 34 could be configured as slip buckle 34' and include only posts 114' and 116' (FIG. 8*a*).

Figure 8:
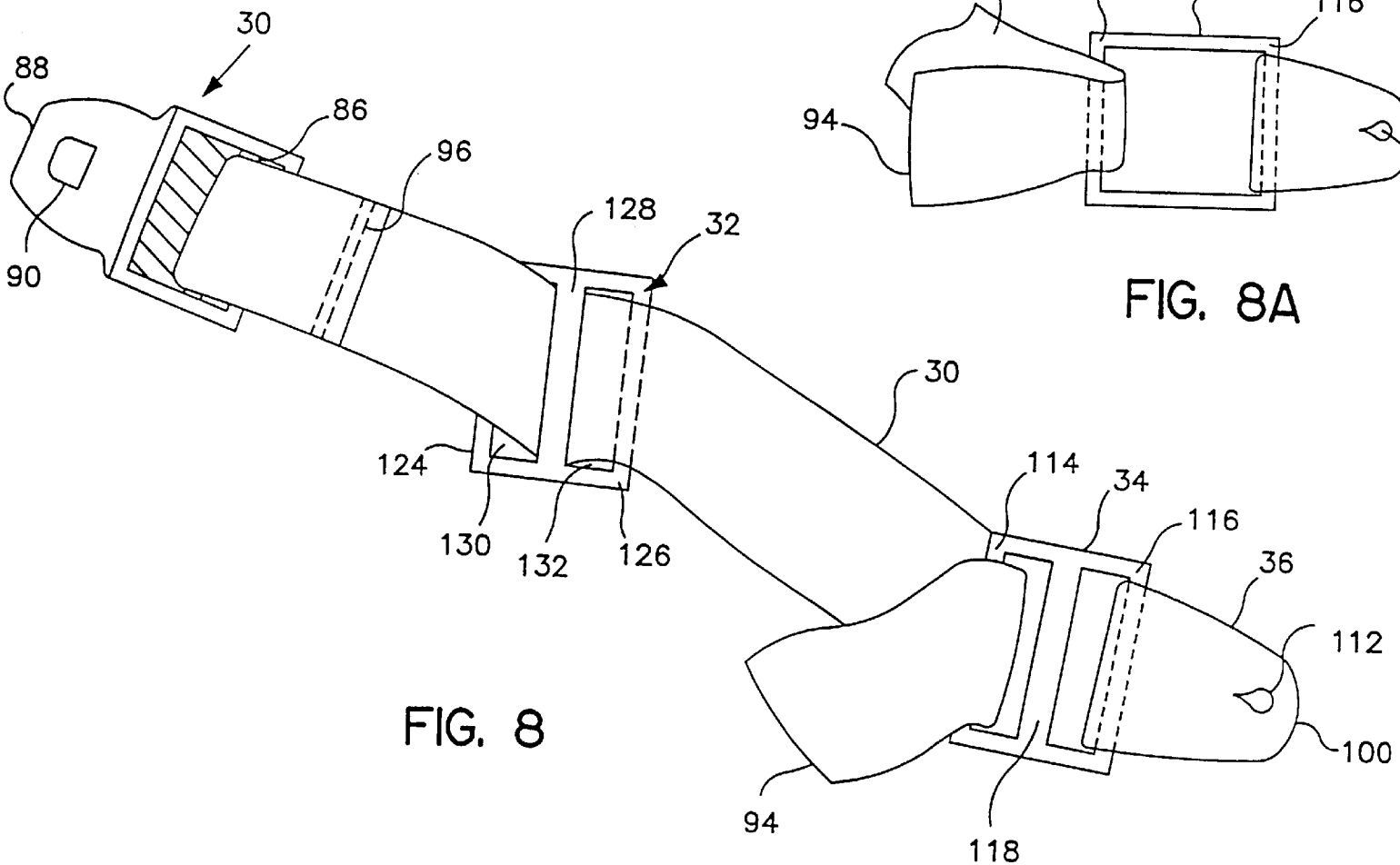
FIGS. 8 and 9 show additional steps in the manufacture of the second major component of the strap of FIG. 1.

The slip buckle 32 is preferably identical to the slip buckle 34 and includes end posts 124 and 126, with middle post 128 there between to define apertures 130 and 132. Turning to FIG. 8, further assembly of the adjustable length member 20 may be accomplished by passing the end 94 of the strap member 30 through the apertures 130 and 132 and around middle post 128 of the buckle member 32. End 94 is then passed through aperture 120 and around end post 114 of slip buckle 34.

Figure 9:
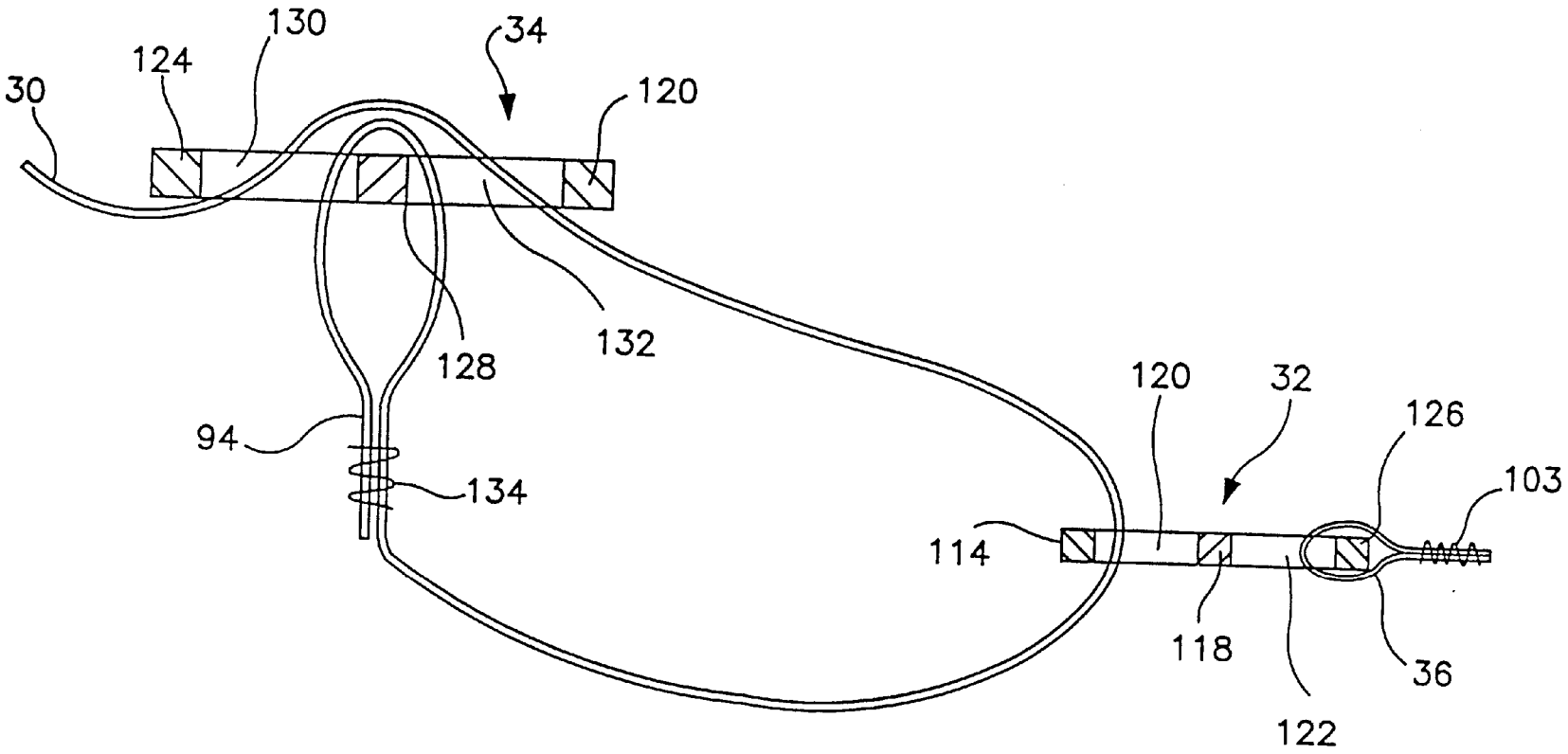

Next, as shown in FIG. 9, the free end 94 of the strap member 30 is passed in opposite directions through apertures 130 and 132 and around middle post 128 of the slip buckle 32, with the end 94 being passed below the portion of the strap member 30 already installed on the slip buckle 32. The end 94 is then pulled about 2 inches past the middle post 118 and secured to the strap 30 as by stitches 134.

Alternatively, the slip buckles 32 and 34 may be installed on the strap 30 first, with the free end 94 then secured to itself around the middle post 118. Then, the end 92 is passed around the post 86 and secured to itself as by stitches 96. In this regard, it will be understood that the order of assembly is not critical and that the individual steps may be accomplished in various sequences.

Figure 10A:
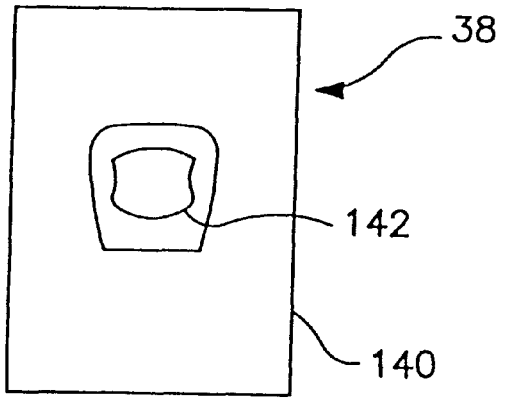
FIGS. 10*a* and 10*b* show steps in the manufacture of an indicia bearing member which may attached to the second major component for aesthetic purposes.
Figure 10B:
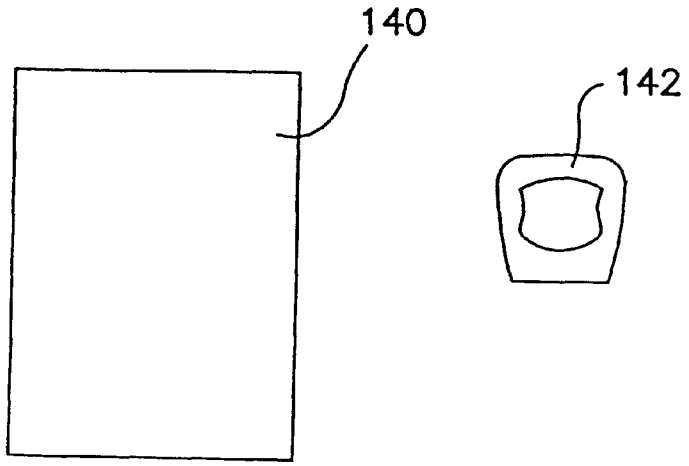

For the purpose of aesthetics, it is preferred to incorporate one or more indicia bearing members 38 with the strap 10. As shown in FIGS. 10*a* and 10*b*, the indicia bearing member 38 preferably includes a portion 140 of a durable sheet material, such as leather, having a width corresponding to the width of the straps 24 and 30 and a length slightly greater than that of preferably decorative indicia 142 that is secured too the portion 140 as by adhesive or stitches. The members 38 may be attached to the strap 30 (and/or the strap 24) as by mating hook/loop material, adhesive or stitches 144 (FIG. 2). Also, the indicia 142 may be attached directly to the strap 30 and/or the strap 24. The indicia may preferably be other recycled components.

In accordance with the invention, the major components of the strap 10 are recycled components of automobile seatbelts. For environmental and nostalgic purposes, it is preferred that seat belt components recovered from automobile junkyards be utilized. It has been experienced that at least the male and female buckle members 22 and 28 and the strap members 24 and 30 may be provided by recycling components from used automobile seat belt assemblies. In many cases, these components may need cleaning, but are otherwise functional for the purposes of the invention with little or no modification.

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A strap system for use with a musical instrument, comprising a male seat belt buckle member insertably retainable within a female seat belt buckle member, a first length of seat belt strap material operatively associated with one of the buckle members so as to have a fixed length, and a second length of seat belt strap material operatively associated with the other buckle member so as to have an adjustable length, and a pair of connecting members, each comprising a length of sheet material having an aperture defined adjacent an end thereof configured so as to be engageable with a portion of the instrument with which the strap is to be used.

2. The strap system of claim 1, wherein the instrument comprises a guitar.

3. A strap system for use with a musical instrument, comprising a male seat belt buckle member insertably retainable within a female seat belt buckle member, a first length of seat belt strap material operatively associated with one of the buckle members, and a second length of seat belt strap material operatively associated with the other buckle member, and a pair of connecting members, each connecting member having one end associated with one of the strap members and an opposite an end thereof configured so as to be engageable with a portion of the instrument with which the strap is to be used.

* * * * *